US010132500B2

(12) United States Patent
Ryon et al.

(10) Patent No.: US 10,132,500 B2
(45) Date of Patent: Nov. 20, 2018

(54) AIRBLAST INJECTORS

(71) Applicant: Delavan Inc, West Des Moines, IA (US)

(72) Inventors: Jason A. Ryon, Carlisle, IA (US); Lev A. Prociw, Johnston, IA (US)

(73) Assignee: DELAVAN INC., West Des Moines, IA (US)

( * ) Notice: Subject to any disclaimer, the term of this patent is extended or adjusted under 35 U.S.C. 154(b) by 374 days.

(21) Appl. No.: 14/885,182

(22) Filed: Oct. 16, 2015

(65) Prior Publication Data

US 2017/0108223 A1 Apr. 20, 2017

(51) Int. Cl.

| | |
|---|---|
| ***F23R 3/36*** | (2006.01) |
| ***F23R 3/12*** | (2006.01) |
| ***F23R 3/28*** | (2006.01) |

(52) U.S. Cl.

CPC ..... *F23R 3/36* (2013.01); *F23R 3/12* (2013.01); *F23R 3/286* (2013.01)

(58) Field of Classification Search

CPC .... F23R 3/12; F23R 3/386; F23R 3/28; F23R 3/36

See application file for complete search history.

(56) References Cited

U.S. PATENT DOCUMENTS

| | | | | |
|---|---|---|---|---|
| 3,980,233 | A * | 9/1976 | Simmons | F23D 11/107 239/400 |
| 4,600,151 | A * | 7/1986 | Bradley | F23D 11/107 239/400 |
| 5,505,045 | A * | 4/1996 | Lee | F23D 11/107 239/424 |
| 6,688,534 | B2 * | 2/2004 | Bretz | F23D 11/107 239/135 |
| 8,015,815 | B2 * | 9/2011 | Pelletier | F23R 3/14 239/132 |
| 8,240,151 | B2 * | 8/2012 | Pelletier | F23D 11/107 60/740 |
| 9,033,263 | B2 | 5/2015 | Rackwitz | |
| 9,618,209 | B2 * | 4/2017 | Bandaru | F23R 3/28 |
| 2011/0203284 | A1 | 8/2011 | Ritland et al. | |

(Continued)

FOREIGN PATENT DOCUMENTS

| | | |
|---|---|---|
| EP | 2525152 A2 | 11/2012 |
| EP | 2589866 A2 | 5/2013 |
| GB | 2293001 A | 3/1996 |

OTHER PUBLICATIONS

Extended European Search Report dated Mar. 20, 2017, issued during the prosecution of European Patent Application No. EP 16194123.2 (7 pages).

*Primary Examiner* — Carlos A Rivera

(74) *Attorney, Agent, or Firm* — Locke Lord LLP; Scott D. Wofsy; Christopher J. Cillie

(57) ABSTRACT

An injector includes a fuel distributor with a first fluid inlet and a first fluid outlet, with a first fluid circuit for fluid communication between the first fluid inlet and the first fluid outlet. The fuel distributor includes a second fluid inlet and a second fluid outlet, with a second fluid circuit for fluid communication between the second fluid inlet and outlet. The fuel distributor defines a spray axis. The first and second fluid outlets can be radially adjacent and/or can be substantially aligned axially relative to the spray axis, e.g., for issuing multiple different fuels from substantially the same outlet.

12 Claims, 3 Drawing Sheets

(56) References Cited

U.S. PATENT DOCUMENTS

| | | | | |
|---|---|---|---|---|
| 2014/0245742 | A1* | 9/2014 | Chew | F23R 3/14 60/748 |
| 2014/0338337 | A1 | 11/2014 | Prociw et al. | |
| 2014/0339339 | A1 | 11/2014 | Prociw | |
| 2015/0253010 | A1 | 9/2015 | Schlein | |
| 2016/0209038 | A1* | 7/2016 | Kopp-Vaughan | F23C 1/08 |

* cited by examiner

AIRBLAST INJECTORS

BACKGROUND OF INVENTION

1. Field of the Invention

The present disclosure relates to airblast injection nozzles, and more particularly to injectors for multiple fuels such as used in industrial gas turbine engines.

2. Description of Related Art

Multipoint lean direct injection (LDI) for gas turbine engines is well known in the art. Multipoint refers to the use of a large number of small airblast injector nozzles to introduce the fuel and air into the combustor. By using many very small airblast injector nozzles there is a reduction of the flow to individual nozzles, therein reducing the diameter of the nozzle. The volume of recirculation zone downstream of the nozzle is thought to be a controlling parameter for the quantity of NOx produced in a typical combustor. If the recirculation volume is proportional to the cube of the diameter of the mixer, and if the NOX produced is proportional to the recirculation volume, and the fuel flow is taken to be proportional to the square of the diameter of the mixer, then a larger nozzle will produce greater fuel flow, but also a greater emission index of NOX (EINOX).

Such conventional methods and systems generally have been considered satisfactory for their intended purpose. There remains a need in the art for improved airblast injectors. The present disclosure provides a solution for these problems.

SUMMARY OF THE INVENTION

An injector includes a fuel distributor with a first fluid inlet and a first fluid outlet, with a first fluid circuit for fluid communication between the first fluid inlet and the first fluid outlet. The fuel distributor includes a second fluid inlet and a second fluid outlet, with a second fluid circuit for fluid communication between the second fluid inlet and outlet. The fuel distributor defines a spray axis. The first and second fluid outlets can be radially adjacent and/or can be substantially aligned axially relative to the spray axis, e.g., for issuing multiple different fuels from substantially the same outlet.

The fuel distributor can include an outer distributor ring, an intermediate distributor ring mounted within the outer distributor ring, wherein the first fluid circuit is defined between the intermediate and outer distributor rings, and an inner distributor ring mounted within the intermediate distributor ring, wherein the second fluid circuit is defined between the intermediate and inner distributor rings. At least one of the first and second fluid circuits can include a passage defined along a cone.

The outer distributor ring can include an internal conical surface with a helically threaded fluid passage defined therein, e.g., a multiple-start helically threaded fluid passage, wherein the first fluid circuit is defined between a helically threaded fluid passage of the internal conical surface of the outer distributor ring and an outer conical surface of the intermediate distributor ring. A braze and/or weld joint can mount the intermediate and outer distributor rings together, wherein the joint bounds the fluid circuit for confining fluid flowing therethrough.

The inner distributor ring can include an outer surface with a helically threaded fluid passage defined therein, e.g., a multiple-start helically threaded fluid passage, wherein the second fluid circuit is defined between a helically threaded fluid passage of the outer surface of the inner distributor ring and the intermediate distributor ring. A braze and/or weld joint can mount the intermediate and inner distributor rings together, wherein the joint bounds the second fluid circuit for confining fluid flowing therethrough.

An inner heat shield can be mounted inboard of the inner distributor ring for thermal isolation of fuel in the distributor from compressor discharge air inboard of the inner heat shield. A core air swirler can be mounted inboard of the inner heat shield for swirling compressor discharge air inboard of the fuel distributor for airblast injection of fuel issued from the fuel distributor. An outer heat shield assembly can be mounted outboard of the outer distributor ring for thermal isolation of fuel in the fuel distributor from compressor discharge air outboard of the fuel distributor.

The outer heat shield assembly can define an outer air circuit configured and adapted to issue compressor discharge air, e.g., in a swirl-free flow of air therethrough, outboard of fuel issued from the fuel distributor. It is also contemplated that the outer air circuit can be configured and adapted to issue a converging flow of air therethrough to enhance swirl imparted on a flow of compressor discharge air issued from the core air swirler.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
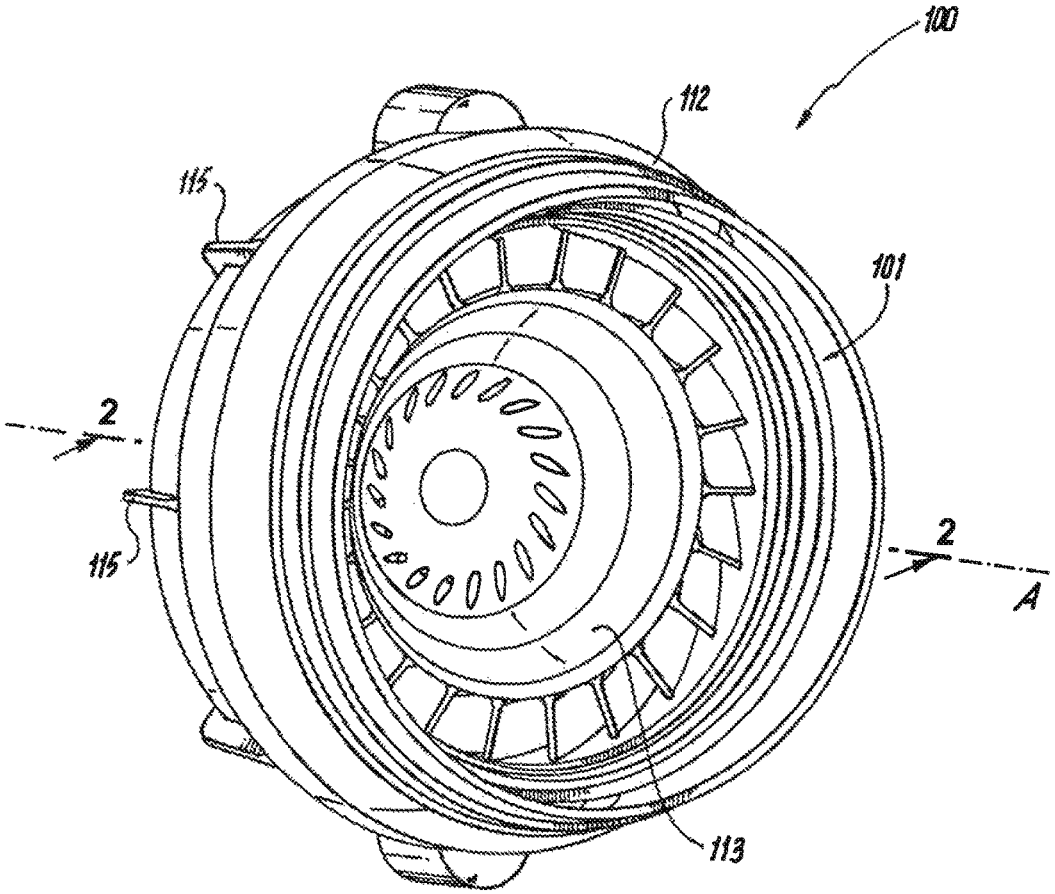
FIG. 1 is a perspective view of an exemplary embodiment of an airblast injector constructed in accordance with the present disclosure.

Reference will now be made to the drawings wherein like reference numerals identify similar structural features or aspects of the subject disclosure. For purposes of explanation and illustration, and not limitation, a partial view of an exemplary embodiment of an injector in accordance with the disclosure is shown in FIG. 1 and is designated generally by reference character 100. Other embodiments of injectors in accordance with the disclosure, or aspects thereof, are provided in FIGS. 2-4, as will be described. The systems and methods described herein can be used to provide injection of multiple fuels, for example in industrial gas turbine engines.

Figure 2:
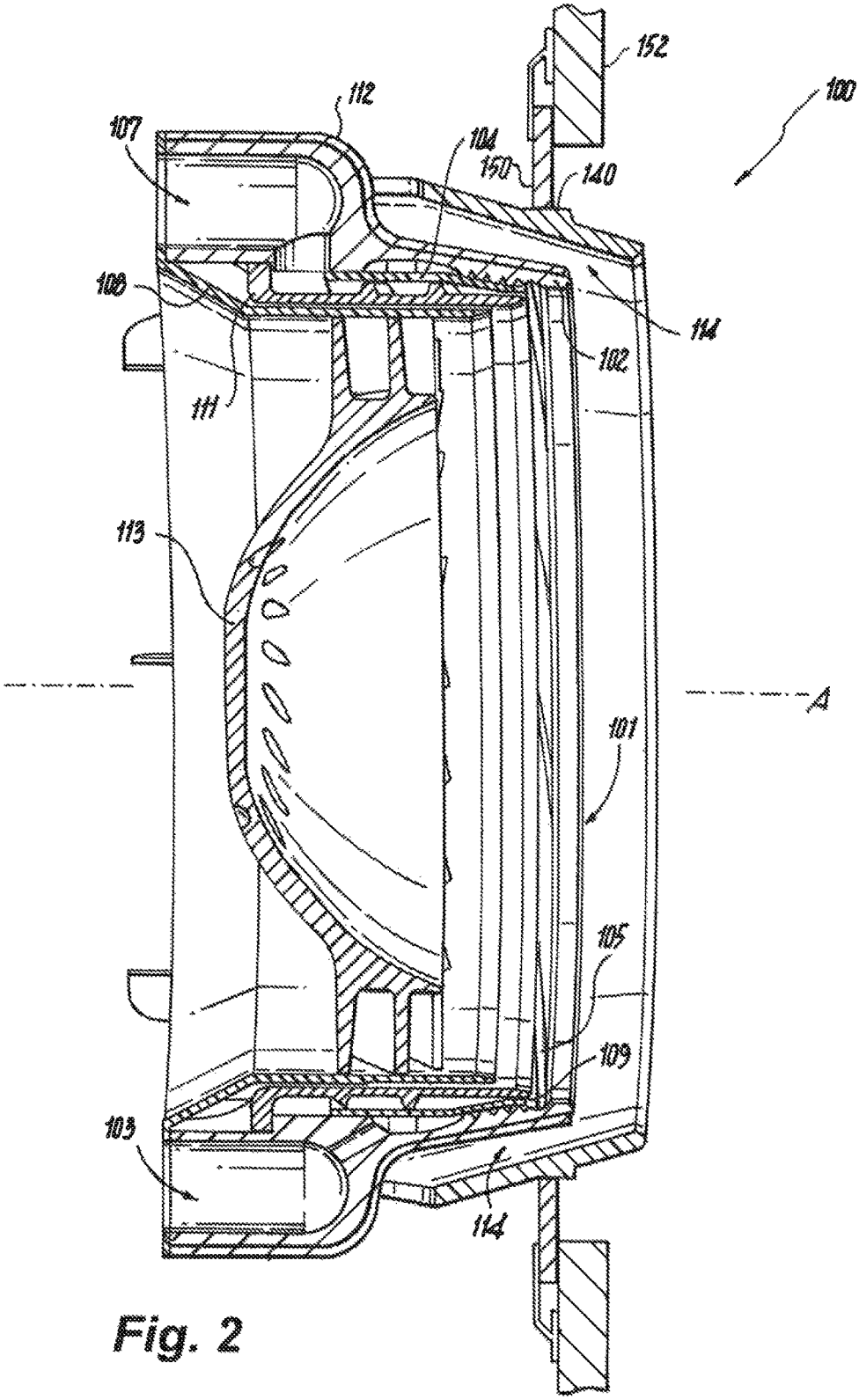
FIG. 2 is a cross-sectional perspective view of a portion of the injector of FIG. 1, showing the fuel inlets.
Figure 3:
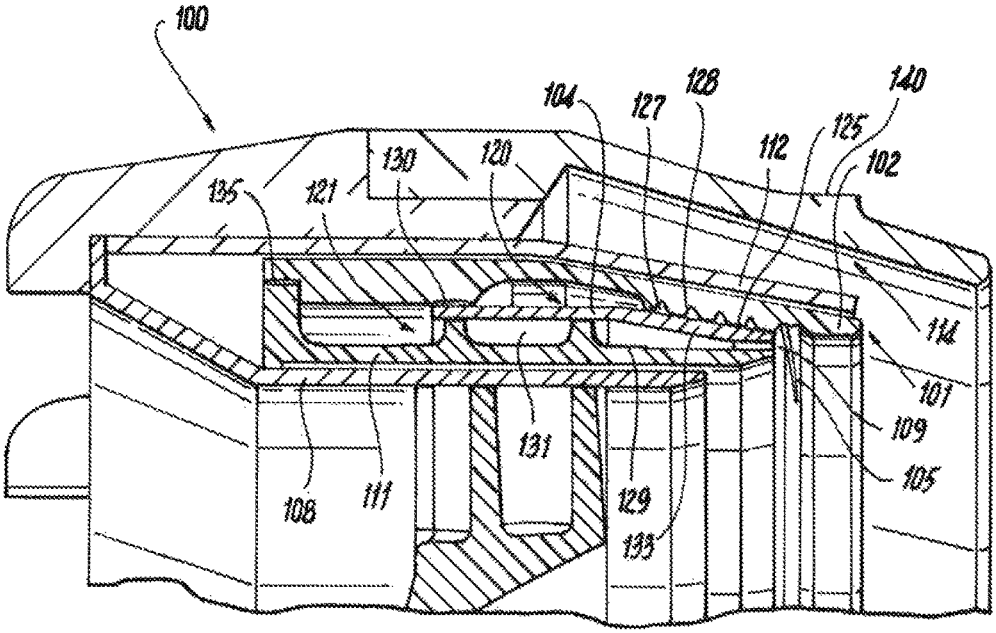
FIG. 3 is a cross-sectional perspective view of a portion of the injector of FIG. 1, showing the fuel distribution channels for the two fuel circuits.

With reference to FIG. 1, injector 100 can be used for injection of multiple different fuels from substantially the same outlet, for example in a multipoint fuel injection system of an industrial gas turbine engine. As shown in FIGS. 2 and 3, injector 100 includes a fuel distributor 101 with a first fluid inlet 103 and a first fluid outlet 105, with a first fluid circuit 120 for fluid communication between the first fluid inlet 103 and the first fluid outlet 105. Fuel distributor 101 also includes a second fluid inlet 107 and a second fluid outlet 109, with a second fluid circuit 121 for fluid communication between the second fluid inlet 107 and outlet 109. The fuel distributor defines a spray axis A. As shown in FIG. 3, the first and second fluid outlets 105 and 109 are radially adjacent and substantially aligned axially relative to the spray axis A, e.g., for issuing multiple different fuels from substantially the same outlet. A first fuel, e.g., a liquid fuel, can be supplied at fluid inlet 103, pass through the first fluid circuit 120, and issue from fluid outlet 105. A second fuel, e.g., a gaseous fuel, can be supplied at fluid inlet 107, pass through the second fluid circuit 121, and can be issued from fluid outlet 109.

With reference to FIG. 2, Fuel distributor 101 includes an outer distributor ring 102 and an intermediate distributor ring 104 mounted within the outer distributor ring 102. As shown in FIG. 3, the first fluid circuit 120 of fuel distributor 101 is defined between the intermediate and outer distributor rings 104 and 102. An inner distributor ring 111 is mounted within intermediate distributor ring 104. The second fluid circuit of fuel distributor 102 is defined between the intermediate and inner distributor rings 104 and 111.

Injector 100 includes an inner heat shield 108 mounted inboard of inner distributor ring 111 for thermal isolation of fuel in fuel distributor 101 from compressor discharge air inboard of inner heat shield 108. Injector 100 further includes a core air swirler 113 mounted inboard of inner heat shield 108 for swirling compressor discharge air inboard of fuel distributor 101 for airblast injection of fuel issued from fuel distributor 101. An outer heat shield assembly 112 is mounted outboard of outer distributor ring 102 for thermal isolation of fuel in fuel distributor 101 from compressor discharge air outboard of fuel distributor 101. Floating collar 150 of combustor wall 152 seals against cylindrical air seal 140.

With reference to FIG. 3, outer heat shield assembly 112 defines an outer air circuit 114 configured and adapted to issue compressor discharge air outboard of fuel issued from fuel distributor 101. Outer air circuit 114 is configured and adapted to issue a swirl-free flow of air therethrough, i.e., vanes 115, shown in FIG. 1, are axially aligned rather than tangentially aligned which would induce swirl. Those skilled in the art will readily appreciate that outer air circuit 114 could readily be reconfigured for swirling outer air as suitable for particular applications without departing from the scope of this disclosure. Since outer air circuit 114 converges toward the central axis, outer air circuit 114 issues a converging flow of air therethrough to enhance swirl imparted on a flow of compressor discharge air issued from core air swirler 113.

Fluid circuit 120 is for fluid communication between fluid inlet 103 and fluid outlet 105 and includes a multiple-start helically threaded fluid passage 128, defined along a cone, i.e. internal conical surface 125 of outer distributor ring 102. Fluid circuit 120 is defined between multiple-start helically threaded fluid passage 128 of internal conical surface 125 of outer distributor ring 102 and an outer conical surface 127 of intermediate distributor ring 104. The intermediate and outer distributor rings 104 and 102 can be joined together by a braze and/or weld joint 130, wherein the joint bounds the fluid circuit 120 for confining fluid flowing therethrough.

Although shown and described herein as a three-start helically threaded fluid passage, those skilled in the art will readily appreciate that the passage can be any suitable number of starts for a given application. Typically, it is contemplated that one start should be provided for every 1-inch (2.54 cm) or circumference of the passage, however, any other suitable spacing can be used without departing from the spirit and scope of this disclosure. Those having skill in the art will readily appreciate that the multiple-start thread and multiple individual outlets provide enhanced performance when operating at low pressure, for example, the multiple-starts and multiple outlets of thread allow for even fuel distribution. It is contemplated that any suitable size can be used for distributor 101, based on application, for example sizes could range from 1 inch (2.54 cm) to 10 inches (25.4 cm), or any other suitable size.

Figure 4:
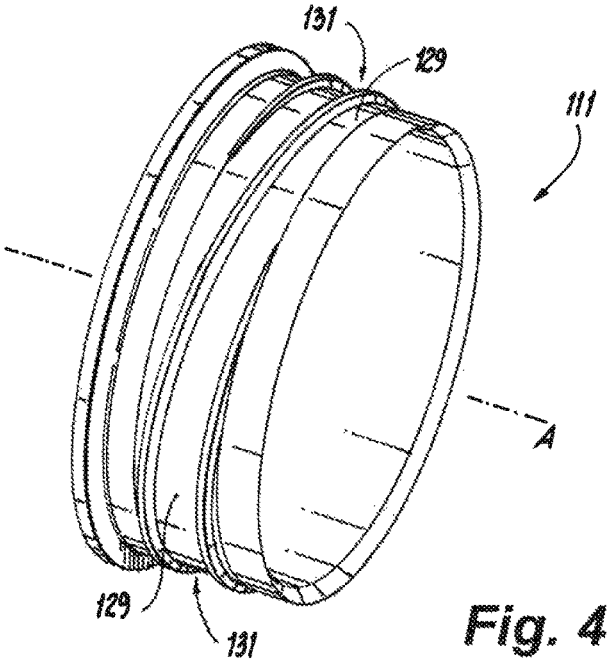
FIG. 4 is a perspective view of a distributor ring of the injector of FIG. 1, showing the threaded fuel passage thereof.

Inner distributor ring 111, shown on its own in FIG. 4, includes an outer surface 129 with a helically threaded fluid passage 131 defined therein, e.g., a multiple-start helically threaded fluid passage, wherein the second fluid circuit 121 is defined between helically threaded fluid passage 131 of the outer surface of inner distributor ring 111 and the intermediate distributor ring 104. The distal end 133 of intermediate distributor ring includes a conical, converging surface that forms part of the second fluid circuit that includes passage 131. The intermediate and inner distributor rings 104 and 111 can be joined together by a weld and/or braze joint 130 and/or 135, which joint or joints bound the second fluid circuit for confining fluid flowing therethrough. The configuration of passage 131 is coarser and has fewer helical fuel passages in number than in distributor ring 102 described above, as passage 131 is configured for gaseous fuel. Those skilled in the art will readily appreciate that the details of the passages can be configured for any suitable fuel configuration, e.g., accounting for density and pressure of the fuel being used, without departing from the scope of this disclosure.

Inner and outer distributor rings 111 and 102 can be joined to intermediate distributor ring 104 with interference fits. The intermediate distributor ring 104 can be engaged in an interference fit with the outer distributor ring 102 by forcefully pulling the intermediate distributor ring 104 towards the outlet of the outer distributor ring 102. A similar process can be used to join inner distributor ring 111 within intermediate distributor ring 104. Those skilled in the art will readily appreciate that due to the conical surfaces involved joining the distributor rings together, an interference fit is not required, for example, the intermediate distributor ring 104 can be disposed within the outer distributor ring 102 and fixed with a weld or braze at joint 130. Those skilled in the art will readily appreciate that without the distributor rings 102 and 104 joined together in an interference fit, fuel will still follow the helically threaded fluid passage 128 due to the pressure differential between the inlet 103 and outlet 105. In addition, those having skill in the art will readily appreciate that sealing the fuel channels can be accomplished by braze, weld, or any other suitable technique.

Referring again to FIGS. 2 and 3, outer heat shield 112 can form the inner air shroud for outer air circuit 114. Both inner and outer heat shields, 108 and 112, can be configured to attach together at the back of injector 100 where an air sealing weld or braze can be located. Once attached, the heat shields, 108 and 112, thermally encapsulate distributor rings 111, 104 and 102, allowing them to remain at around fuel temperature even if the air is at a much higher temperature as it arrives from the compressor. Gaps between adjacent shells permit the hot components to grow radially and axially unimpeded by the cold components. Zones where hot air can touch the fuel conveying components are reduced to an absolute minimum. By keeping injector 100 components small, the heat shielding is kept at a reduced weight as compared to conventional injectors. Combining functionality of heat shields 108 and 112 keep cost of the components to a minimum.

Fuel circuits 120 and 121 can be used independently of one another, one at a time or together. Regardless of whether fuel circuit 120 or 121 or both are being used, the fuel is issued from substantially the same annular outlet area of distributor 101, which is allocation between the inner, high swirl air and the outer low to no swirl air, which results in advantageous mixing of either or both fuels. This provides similar behavior for both fuels, including similar mass and momentum distribution relative to the air flow regardless of which fuel is used. During operation of fuel circuit 120 only, fuel circuit 121 can act as a heat shield as described above to reduce or prevent coking of fuel in fuel circuit 120, e.g. a liquid fuel. During operation of fuel circuit 121 only, fuel circuit 120 can similarly act as a heat shield. Purge air can optionally be used to prevent fuel from the active fuel circuit 120 or 121 from back flowing into the inactive fuel circuit or circuits. While shown and described with each fuel circuit 120 and 121 having a single inlet, one or more additional inlets can optionally be included for each fuel circuit, and the distribution channels of the fuel circuits 120 and 121 can be configured such that fuel is well distributed, e.g., in a thin film or atomized annulus of liquid or gaseous fuel, when is injected into the combustor area.

While shown and described in the exemplary context of multipoint injection for gas turbine engines, those skilled in the art will readily appreciate that the apparatus and method described herein can be used for any other suitable application. Moreover, while the apparatus is shown in the exemplary process described herein, those skilled in the art will readily appreciate that it can be made by any other suitable process or processes without departing from the scope of this disclosure. While shown and described in the exemplary context of two fuel circuits, those skilled in the art will readily appreciate that any suitable number of fuel circuits can be used without departing from the scope of this disclosure. While described with the example of having a gas and a liquid fuel, those skilled in the art will readily appreciate that two liquid fuels can be used, two gaseous fuels can be used, or any other suitable combination of fuels. While described herein in the exemplary context of helical threaded fuel channels, those skilled in the art will readily appreciate that any other suitable type of fuel channels can be used, including slots, drilled holes, or the like.

The methods and systems of the present disclosure, as described above and shown in the drawings, provide for injection with superior properties including low pollutant injection of multiple fuels. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An injector comprising:

a fuel distributor with a first fluid inlet and a first fluid outlet, with a first fluid circuit for fluid communication between the first fluid inlet and the first fluid outlet, wherein the fuel distributor includes a second fluid inlet and a second fluid outlet, with a second fluid circuit for fluid communication between the second fluid inlet and outlet, wherein the fuel distributor includes:

an outer distributor ring;

an intermediate distributor ring mounted within the outer distributor ring, wherein the first fluid circuit is defined between the intermediate and outer distributor rings; and an inner distributor ring mounted within the intermediate distributor ring, wherein the second fluid circuit is defined between the intermediate and inner distributor rings, wherein the outer distributor ring includes an internal conical surface with a helically threaded fluid passage defined therein, and wherein the first fluid circuit is defined between the helically threaded fluid passage of the internal conical surface of the outer distributor ring and an outer conical surface of the intermediate distributor ring, and wherein the inner distributor ring includes an outer surface with a helically threaded fluid passage defined therein, and wherein the second fluid circuit is defined between the helically threaded fluid passage of the outer surface of the inner distributor ring and the intermediate distributor ring.

2. The injector as recited in claim 1, wherein the fuel distributor defines a spray axis, wherein the first and second fluid outlets are radially adjacent and are substantially aligned axially relative to the spray axis.

3. The injector as recited in claim 1, further comprising a braze joint mounting the intermediate and outer distributor rings together, wherein the braze joint bounds the fluid circuit for confining fluid flowing therethrough.

4. The injector as recited in claim 1, wherein the outer distributor ring includes an internal conical surface with a multiple-start helically threaded fluid passage defined therein, and wherein the first fluid circuit is defined between the multiple-start helically threaded fluid passage of the internal conical surface of the outer distributor ring and an outer conical surface of the intermediate distributor ring.

5. The injector as recited in claim 1, further comprising a weld joint mounting the outer and intermediate distributor rings together, wherein the weld joint bounds the first fluid circuit for confining fluid flowing therethrough.

6. The injector as recited in claim 1, further comprising a braze joint mounting the intermediate and inner distributor rings together, wherein the braze joint bounds the second fluid circuit for confining fluid flowing therethrough.

7. The injector as recited in claim 1, wherein the inner distributor ring includes an outer surface with a multiple-start helically threaded fluid passage defined therein, and wherein the second fluid circuit is defined between the multiple-start helically threaded fluid passage of the outer surface of the inner distributor ring and the intermediate distributor ring.

8. The injector as recited in claim 1, further comprising a weld joint mounting the inner and intermediate distributor rings together, wherein the weld joint bounds the second fluid circuit for confining fluid flowing therethrough.

9. The injector as recited in claim 1, further comprising:

an inner heat shield mounted inboard of the inner distributor ring for thermal isolation of fuel in the distributor from compressor discharge air inboard of the inner heat shield;

a core air swirler mounted inboard of the inner heat shield for swirling compressor discharge air inboard of the fuel distributor for airblast injection of fuel issued from the fuel distributor; and an outer heat shield assembly mounted outboard of the outer distributor ring for thermal isolation of fuel in the fuel distributor from compressor discharge air outboard of the fuel distributor.

10. The injector as recited in claim 9, wherein the outer heat shield assembly defines an outer air circuit configured and adapted to issue compressor discharge air outboard of fuel issued from the fuel distributor.

11. The injector as recited in claim 10, wherein the outer air circuit is configured and adapted to issue a swirl-free flow of air therethrough.

12. The injector as recited in claim 10, wherein the outer air circuit is configured and adapted to issue a converging flow of air therethrough to enhance swirl imparted on a flow of compressor discharge air issued from the core air swirler.

* * * * *